United States Patent [19]

Lutz

[11] 4,438,645

[45] Mar. 27, 1984

[54] LEVELLER FOR MOTOR VEHICLES

[75] Inventor: Horst Lutz, Stuttgart, Fed. Rep. of Germany

[73] Assignee: Daimler-Benz Aktiengesellschaft, Fed. Rep. of Germany

[21] Appl. No.: 441,059

[22] Filed: Nov. 12, 1982

Related U.S. Application Data

[63] Continuation of Ser. No. 938,955, Sep. 1, 1978, abandoned.

[30] Foreign Application Priority Data

Sep. 1, 1977 [DE] Fed. Rep. of Germany ..... 2739368

[51] Int. Cl.[3] ..... B21D 1/14

[52] U.S. Cl. ..... 72/482; 72/705; 269/296

[58] Field of Search ..... 269/296, 319; 72/446, 72/447, 478, 481, 482, 705; 428/558, 645, 661, 678, 670, 672, 354 P; 74/16

[56] References Cited

U.S. PATENT DOCUMENTS

| | | | |
|---|---|---|---|
| 2,140,686 | 12/1938 | Bennett | 72/705 |
| 2,491,117 | 12/1949 | Langham | 72/705 |
| 2,717,020 | 9/1955 | Dobias | 72/705 |
| 3,034,563 | 5/1962 | Gaspar et al. | 72/705 |
| 3,214,959 | 11/1965 | Bowden | 72/705 |
| 3,501,938 | 3/1970 | Sprague | 72/705 |
| 3,626,747 | 12/1971 | Rouis | 72/705 |
| 4,033,531 | 7/1977 | Levine | 248/558 |

FOREIGN PATENT DOCUMENTS

| | | | |
|---|---|---|---|
| 2145992 | 3/1973 | Fed. Rep. of Germany | 72/705 |
| 2831627 | 2/1979 | Fed. Rep. of Germany | 72/705 |
| 2246322 | 5/1975 | France | 72/705 |
| 38635 | 7/1965 | German Democratic Rep. | 72/705 |

*Primary Examiner*—Lowell A. Larson
*Attorney, Agent, or Firm*—Craig & Burns

[57] ABSTRACT

A straightener for motor vehicles which includes a bench frame having a pair of spaced longitudinal beams interconnected by cross beams. Mounting plates are appropriately disposed at predetermined intervals along the length of the longitudinal beams with the mounting plates being provided with mounting holes for mounting either cross members or intermediate beams supporting the cross members such that adapters associated with the vehicle mounting points are supported on the cross members. The intermediate beams have a length which is at least essentially equal to a length of the longitudinal beams and are provided with holes corresponding to mounting holes of the mounting plates or cross members, together with additional holes arranged in a grid pattern along the length of the intermediate beams.

11 Claims, 4 Drawing Figures

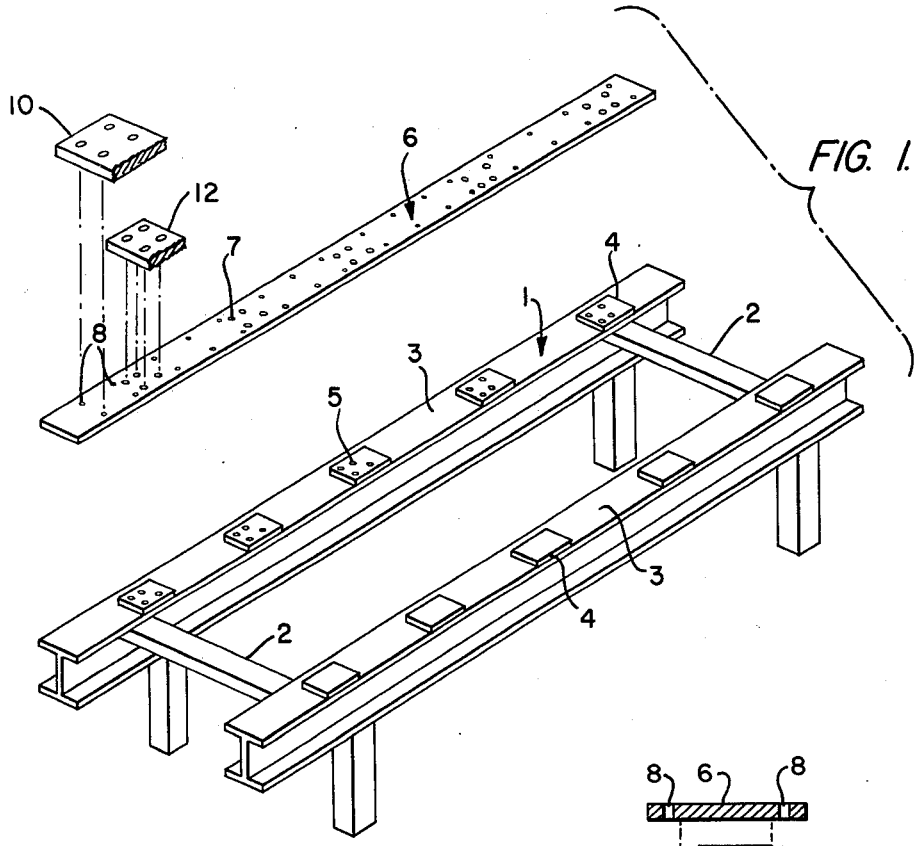
FIG. 1.
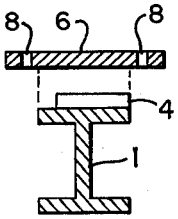
FIG. 4
FIG. 2.
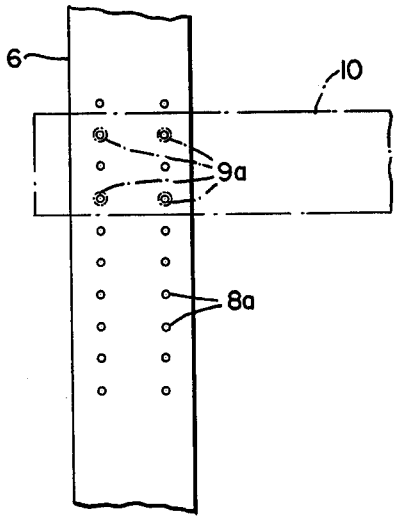
FIG. 3.
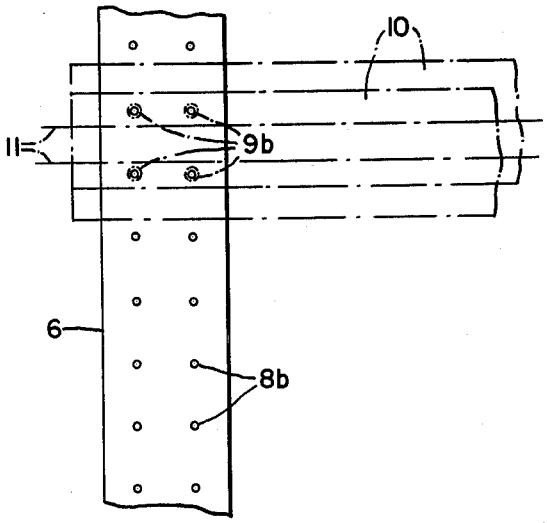

LEVELLER FOR MOTOR VEHICLES

This is a continuation of application Ser. No. 938,955, filed Sept. 1, 1978, now abandoned.

The invention relates to a straightener for motor vehicles, the straightener including a bench frame having opposed longitudinally extending beams connected by cross beams with the longitudinal beams being appropriately provided with mounting plates disposed at predetermined intervals with respect to each other along the length of each of the longitudinally extending beams, which plates are provided with mounting holes for cross members mounted on them or for intermediate beams supporting cross members and mounted on successive mounting plates so that adapters associated with vehicle fastening points may be supported on the cross members. Straighteners of the aforementioned type constitute, for all practical purposes, basic equipment in motor vehicle workshops performing body work and, under normal conditions, the tools designed for use on specific makes or types of motor vehicles are fitted to the bench frame as tool supports. Therefore, to the maximum extent possible, the tools are provided with several hole patterns on the bench frame which correspond to individual positions. However, if the provision of several hole patterns is not possible due to, for example, overlapping in the hole patterns, although the mounting points on the vehicle remain the same, as in the case of a series of motor vehicles with several wheel bases, additional tools must be manufactured since the tools cannot be shifted due to the variations in the irregular hole pattern in the bench frame which has been laid out to meet preset previous requirements. Thus, a corresponding systematization is no longer possible since the duplicate tools have high intrinsic values and have been tailored to the previous bench frame. While additional systematized bench frames for new makes and types of motor vehicles could be installed, this offers an impractical solution to the problem because of the additional capital investment required for the new bench frame and also because a bench frame as such takes up a relatively large amount of space which in most cases is not available. The invention is designed to provide a solution indicating how the existing elements can be used to achieve future systematization of the bench frame.

According to the invention intermediate beams are provided which extend at least essentially over the length of the longitudinal beams and are provided with holes corresponding to mounting holes of mounting plates and/or cross members, with additional holes being provided and arranged in a grid pattern on the intermediate beams.

By virtue of the construction in accordance with the present invention, it is possible to work according to a grid system in future designs and to employ previous designs regardless of subsequent developments, whereby a previous set of intermediate beams makes it possible to work both with the grid holes and the holes that correspond to the previous holes without reequipping the basic straightener unit. Consequently, what is provided by the present invention is a straightening system which is largely independent of the make or type of motor vehicle and which can be used for a wider variety of applications with a lower total capital investment cost. In particular, due to the regularity of the grid system, the positioning of the tools to be mounted on the bench frame can be planned and performed according to a coordinate system.

Preferably, in accordance with the present invention for the grid system, equal distances are provided between the holes in the frame and an intermediate beam is advantageously associated with each of the longitudinal beams. The intermediate beam can advantageously be formed by a flat section, connected at a number of points along its length with the respective longitudinal beams. In addition to the flat sections, welded structures or U-shaped sections, and, especially, angular sections can also be used within the framework of the present invention.

According to the invention, the intermediate girders may be wider than the longitudinal girders, the grid holes can be provided in the intermediate beam laterally outside the longitudinal beam so that the holes in the intermediate beams and longitudinal beams will not overlap, and the grid can be laid out without regard to the previous hole pattern in the longitudinal beams.

Advantageously, according to the present invention, the cross members, in addition to the mounting holes associated with the grid holes, may be provided with mounting holes associated with the mounting holes of the mounting plates in order to be able to utilize the cross members in a versatile manner in conjunction with the intermediate beams for future makes or types of vehicles.

According to a further advantageous feature of the present invention, the grid pattern of the mounting holes of the cross members, corresponding to the grid holes, may be a whole number multiple of the grid pattern of the grid holes so as to provide a distribution of holes which is as closely matched as possible and, therefore, easily adjustable to different conditions.

Advantageously, according to the present invention, the mounting holes, corresponding to the grid holes, may be located asymmetrically relative to a transverse central plane of the cross members, and the cross members may be fastened in two positions rotated through 180° with respect to one another, relative to the intermediate member, so that lengthwise adjustment is possible depending on the selected position.

Other features and advantages will become more apparent from the following description when taken in connection with the accompanying drawing which shows only one embodiment in accordance with the present invention, and wherein:

FIG. 1 is a schematic perspective view of a bench frame of a straightener, with an associated intermediate beam in accordance with the present invention;

FIGS. 2 and 3 are schematic illustrations of two alternative methods of mounting cross members on the intermediate beam in accordance with the present invention; and FIG. 4 shows a modification of an intermediate beam of the invention.

Referring now to the drawings wherein like reference numerals are used throughout the various views to designate like parts and, more particularly, to FIG. 1, according to this figure, a straightener comprises a bench frame generally designated by the reference numeral 1; provided with longitudinal girders 3 connected by cross beams 2. The longitudinal beams 3 are constructed as I-beams and have mounted thereon mounting plates 4 arranged sequentially along the length of the longitudinal beams 3, the plates 4 are provided with mounting holes 5, only some of which are shown in the drawings. Cross members not shown may also be provided with holes which correspond in their arrangement to mounting holes 5 in mounting plates 4 of longitudinal beams 3. The holes in the cross members may be provided with adapters for associated mounting points on the vehicles not shown.

An intermediate beam generally designated by reference numeral 6, only one of which is shown in the drawing, is mounted on each longitudinal beam 3 with each of the intermediate beams 6 being provided with holes corresponding to the mounting holes 5 in the mounting plates 4 of the longitudinal beams 3.

In addition to holes 7, the intermediate beams 6 are provided with holes 8, disposed in accordance with a regular grid. In the illustrated embodiment of FIG. 1, the holes 8 are arranged sequentially in pairs spaced at regular intervals from each other along the length of the intermediate beams 6. The holes 8 are normally displaced relative to the holes 7 which correspond to the mounting holes 5 in the mounting plates 4 so that it is possible to either lock the intermediate beams 6 relative to the mounting plates 4 or, regardless of the intermediate beam 6 disposed on top of the longitudinal beams 3, to fasten cross members 12 to the mounting plates 4, which cross members 12 have a hole pattern corresponding to the hole pattern of the mounting plates 4.

However, it is also possible to fasten cross members 10 to the intermediate beams provided with hole patterns which correspond to the grid holes 8 so that bench frames of the illustrated type with irregularly arranged mounting holes 5 can be connected to cross members which are provided with holes arranged regularly to correspond to the grid of holes 8 without making any subsequent changes to the bench frame 1. In the embodiment of FIG. 1, the grid holes 8, as with the holes 7, are located above the longitudinal beam 3 when the width of the intermediate beam 6 roughly corresponds to the width of the longitudinal beam 3. However, disposition of the grid holes 8 in such a manner can result in an overlapping of grid holes 8 and holes 7 which correspond to mounting holes 5. A solution to this difficulty is shown in FIG. 4. To prevent such overlapping, intermediate beams 6 may be constructed so as to be somewhat wider than the longitudinal beams 3 so that the grid holes 8 can also be displaced laterally relative to the longitudinal beam 3.

Independently of this arrangement, grid holes 8 can be formed by threaded bores or, if the position of the grid holes 8 relative to the holes 7 permits, the grid holes 8 can also be provided, in a manner not shown, with nuts or threaded bushings mounted on an under side of the respective intermediate beams 6.

As shown in FIG. 2, a cross member 10 is provided having, for example, four mounting holes **9*a*. In order to provide the largest possible number of adjustments for the cross member 10 to be installed for a given hole grid so as to produce the most versatile opportunity for use of the cross members 10. Advantageously, the distance between grid holes 8*a* in the intermediate beam 6 is a whole number multiple of the mounting holes 9*a* provided in the cross member 10**.

FIG. 3 shows another possibility for setting intermediate positions, which can be utilized independently of or combined with the construction according to FIG. 2. In the construction of FIG. 3 the mounting holes **9*b* of cross member 10 are arranged asymmetrically with respect to longitudinal central plane 11 of the cross member 10. By rotating cross member 10 through 180° about the lengthwise central plane 11, cross member 10 will be displaced relative to longitudinal beam 3 in its lengthwise direction with respect to the grid holes 8*b*. The magnitude of the displacement corresponds to the change in symmetry of mounting holes 9*b* relative to longitudinal central plane 11**. By virtue of the constructional features of the invention, it is possible, without changing the bench frame, in other words without making additional holes or the like, to use the original bench frame in conjunction with cross members which have been displaced relative to their mounting holes on the regular grid of the intermediate beams and with respect to which, in this manner, a start can be made on the basis of predetermined mounting points which can be taken into account even in the design and layout of the adapting tools because of their regular arrangement.

I claim:

1. An aligning stand for motor vehicles with a stand frame comprising longitudinal beams, with mounting plates being provided on the longitudinal beams of said stand frame, crossbeams connecting the longitudinal beams and with said mounting plates being opposite one another and being equipped with fastening holes of a first pattern intermediate beam means for mounting cross member means, the intermediate beam means being equipped with a first configuration of fastening holes of said first pattern, for mounting to said mounting plates and a second plurality of holes of a second pattern different from said first pattern, the disposition of the second plurality of holes is developed as a regular pattern extending approximately over the whole length of an intermediate beam means at discrete positions regularly spaced from adjacent positions repetitively, and cross member means for mounting to said intermediate beam means employing holes of at least one of said first and second patterns.

2. An aligning stand according to claim 1, characterized in that one intermediate beam is associated with each longitudinal beam.

3. An aligning stand according to claim 1, characterized in that the intermediate beam is constructed as a flat section.

4. An aligning stand according to claim 1, characterized in that the intermediate beam means has a width which is greater than a width of the longitudinal beams, and in that the second plurality of holes is provided in the intermediate beam means laterally outside the width of the longitudinal beam.

5. An aligning stand according to claim 1, characterized in that the cross member means is provided only with mounting holes adapted to be associated with the mounting holes of the mounting plates.

6. An aligning stand according to claim 1, characterized in that the cross member means is provided only with mounting holes adapted to be associated with the mounting holes which correspond to the grid pattern of the second plurality of holes provided in the intermediate beam means.

7. An aligning stand according to claim 6, characterized in that the number of mounting holes in the cross member means corresponding to the second plurality of holes arranged in the intermediate beam means is a whole number multiple of the grid pattern of the holes in the intermediate beam means.

8. An aligning stand according to claim 1, characterized in that the mounting holes in the cross member means are arranged assymetrically with respect to a longitudinally extending central plane of the cross member such that, upon a rotation of the cross member through 180° about an axis disposed in the central plane, the cross member will be displaced relative to the intermediate beam means.

9. An aligning stand according to claim 1, characterized in that a cross member means is provided with mounting holes of both said first and second patterns.

10. An aligning stand according to claim 4, characterized in that groups of holes of the first pattern are interspersed between groups of holes of the second pattern, offset therefrom in non-overlapping fashion.

11. An aligning stand according to claim 1, characterized in that the pattern of the second plurality of holes has equal hole intervals longitudinally.

* * * * *